US008701888B2

(12) United States Patent
Liao

(10) Patent No.: US 8,701,888 B2
(45) Date of Patent: Apr. 22, 2014

(54) AIR-SEALED BODY WITH AUTOMATICALLY OPENED AIR VALUE

(76) Inventor: Yaw Shin Liao, Taipei County (TW)

( * ) Notice: Subject to any disclaimer, the term of this patent is extended or adjusted under 35 U.S.C. 154(b) by 369 days.

(21) Appl. No.: 13/167,468

(22) Filed: Jun. 23, 2011

(65) Prior Publication Data

US 2012/0027969 A1 Feb. 2, 2012

(30) Foreign Application Priority Data

Jul. 27, 2010 (TW) ..... 99124674 A

(51) Int. Cl.
*B65D 81/02* (2006.01)
*B65D 81/05* (2006.01)

(52) U.S. Cl.
CPC ..... *B65D 81/052* (2013.01)
USPC ..... 206/522; 383/3

(58) Field of Classification Search
USPC ..... 206/522, 583, 591–594; 383/3
See application file for complete search history.

(56) References Cited

U.S. PATENT DOCUMENTS 7,533,772 B2 * 5/2009 Yoshifusa et al. ..... 206/522
2005/0189257 A1 * 9/2005 Chen et al. ..... 206/522
2006/0032779 A1 * 2/2006 Tanaka et al. ..... 206/522
2007/0090013 A1 * 4/2007 Yoshifusa et al. ..... 206/522
2007/0267094 A1 * 11/2007 Liao et al. ..... 141/114

FOREIGN PATENT DOCUMENTS

JP H05-095851 12/1993
JP 2007238177 A 9/2007
JP 2010126256 A 6/2010
TW 587049 5/2004
WO WO 2009/142372 A1 11/2009

* cited by examiner

*Primary Examiner* — Mickey Yu
*Assistant Examiner* — Chun Cheung
(74) *Attorney, Agent, or Firm* — Muncy, Geissler, Olds & Lowe, P.C.

(57) ABSTRACT

An air-sealed body with automatically opened air valves and a manufacturing method thereof uses a heat resisting material to spread between two inner films. The two inner films are stacked together between two outer films and heat sealed with the outer films to form an air passage and plural air columns therein. Air inlets and heat-sealed blocks are both formed by heat sealing, wherein each heat-sealed block is shrinking gradually from one side thereof near the first transverse heat-sealing line to another. During filing air the two outer films around the air passage are pulled apart in a longitudinal direction, and the air passage will be contracted in a transverse direction and then the two inner films are pulled apart in a longitudinal direction to open the air inlets. Thereafter, after entering the air columns, the air presses the two inner films to close the air columns.

6 Claims, 7 Drawing Sheets

AIR-SEALED BODY WITH AUTOMATICALLY OPENED AIR VALUE

CROSS-REFERENCES TO RELATED APPLICATIONS

This non-provisional application claims priority under 35 U.S.C. §119(a) on Patent Application No. 99124674 filed in Taiwan, R.O.C. on 2010/7/27, the entire contents of which are hereby incorporated by reference.

BACKGROUND OF THE INVENTION

1. Technical Field

The present invention relates to an air-sealed body and a method for manufacturing it, and more particularly to an air-sealed body with automatically opened air valves and a method for manufacturing the same.

2. Related Art

An air-sealed body is made of resin films, air columns formed by means of heat sealing into an airtight state and an air-filling port for air filling are disposed on the enclosure; the enclosure taken as a cushioning material can be used in an internal packing after air is filled in the air columns via the air-filling port.

A conventional air-sealed body disclosed in Japanese Utility Mode Laid-Open Publication No. H5-95851 entitled as "Fluid cylinder', is configured with an independent check valve on each air column, where an air inlet at the top of each check valve is aligned with a heat-sealing line and the all check valves are coupled together; an air passage is expanded to open the check valves after air is filled in the air passage. This kind of structure, however, only allows each air column to be filled with air respectively because the check valves are independent of one another, the simultaneous filling of multiple air columns is impossible. Moreover, cylinder manufacturing is very detailed and complicated, since each check valve must be placed on a predetermined position in the cylinder one by one and heat sealing is then carried out; the check valve cannot be fixed on the cylinder, or an air inlet at the top thereof is positioned beyond the heat-sealing line sealed by a heat-sealing mold once the placement position of the check valve or the position of the sealing of the heat-sealing mold deviates from a normal position; this makes it impossible for the cylinder to be filled with air because the check valve cannot be opened following the expansion of the air passage, even if the air passage is expanded after the air passage is filled with air.

Another air-sealed body structure is disclosed in Taiwan Patent No. 00587049 entitled as "Assembly Structure of Switch Valve of Air-sealed body and Apparatus for Manufacturing Air-sealed body with Switch Valves", wherein two sheets of inner film and one sheet of outer film at one side are adopted to adhere one another together to form a passage of a switch valve for the opening and closing of the entrance of air into the enclosure, and the enclosure is expanded to block the passage after air is filled therein. The patent only describes how to block the air in the enclosure to prevent it from leaking through the switch valve. However, the switch valve will not be pulled apart outward with the two sheets of outer film even if the two sheets of outer film are pushed by the air and then pulled apart outward when the air is guided into the passage to fill in and expand it. The two sheets of inner film will therefore still attach to each other and an air inlet cannot be opened.

Obviously, air cannot enter the enclosure automatically according to the design of the patent.

SUMMARY

To improve an air-sealed body, allowing air inlets thereof to be opened automatically to carry out continuous air filling in order to save air filling time, the air to be shut off automatically during the air filling and locked after the air is shut off, thereby keeping the enclosure from leaking for a long time and simplifying the manufacturing thereof to increase the yield factor thereof, the present invention is proposed.

The present invention therefore proposes an air-sealed body with automatically opened air valves, including: two sheets of outer film, stacked together vertically; two sheets of inner film, placed between the two sheets of outer film; at least one heat resisting material, spread between the two sheets of inner film; a first transverse heat-sealing line, adhered the two sheets of inner film and the two sheets of outer film; plural second transverse heat-sealing lines, positioned at two ends of either outer film and adhered the two sheets of outer film; an air passage, positioned in the two sheets of outer film between the first transverse heat-sealing line and one of the second transverse heat-sealing lines, and including an air-filling port for air filling; plural longitudinal heat-sealing lines, adhered the two sheets of outer film and the two sheets of inner film; plural air columns, positioned between the two sheets of outer film among the first transverse heat-sealing line, the other second transverse heat-sealing line and the longitudinal heat-sealing lines; plural air inlets, formed by heat sealing the two sheets of outer film and the two sheets of inner film together on the portions of the two sheets of inner film on which the heat-sealing material is spread and overlapping with the first transverse heat-sealing line, and adapted to communicate the air passage with the air columns; and plural heat-sealed blocks, at least one part of each heat-sealed block being positioned in the air passage, the heat-sealed blocks adhering the two sheets of outer film and the two sheets of inner film, and each heat-sealed block being shrinking gradually from one side thereof near the first transverse heat-sealing line to another side thereof; wherein, the air entering the air-filling port expands the air passage, allowing the two sheets of outer film to be pulled apart upward and outward in a longitudinal direction and contracted tightly in a transverse direction to drive the heat-sealed blocks to thrust the two sheets of inner film, thereby pulling the portions of the two sheets of inner film on which the heat-sealing material is spread apart upward and outward in a longitudinal direction to open the air inlets, and then press the two sheets of inner film to close the air columns after entering the air columns.

The present invention also proposes a method for manufacturing an air-sealed body with automatically opened air valves, including the following steps: providing two sheets of inner film, and spreading at least one heat resisting material between the two sheets of inner film; stacking two sheets of outer film, and positioning the two sheets of inner film between the two sheets of outer film; using a first transverse heat-sealing line to adhere the two sheets of inner film and the two sheets of outer film, and plural second transverse heat-sealing lines to adhere the two sheets of outer film, where the second transverse heat-sealing lines are positioned at two ends of either outer film, an air passage is formed in the two sheets of outer film between the first transverse heat-sealing line and one of the second transverse heat-sealing lines, the air passage includes an air-filling port for air filling, and plural air inlets are formed on the portions of the two sheets of inner film on which the heat resisting material is spread overlapping with the first transverse heat-sealing line; using plural of longitudinal heat-sealing lines to adhere the two sheets of outer film and the two sheets of inner film together to form plural air columns communicating with the air passage through the air inlets between the two sheets of outer film among the first transverse heat-sealing line, the other second transverse heat-sealing line and the longitudinal heat-sealing lines; and adhering the two sheets of outer film and the two sheets of inner film together to form plural heat-sealed blocks, where at least one part of each heat-sealed block is positioned in the air passage, and the heat-sealed blocks is shrinking gradually from one side thereof near the first transverse heat-sealing line to another side thereof.

The heat-sealed blocks are formed at the predetermined positions of the air passage by means of heat sealing in advance according to the present invention. The two sheets of outer film are thrust by air to pull apart outward when the air is filled in to expand the air passage, a fall of level taking place during the air filling because of the binary configuration of the heat-sealed block. Therefore, the two sheets of outer film are pulled apart upward and outward in a longitudinal direction and contracted in a transverse direction during the air filling, and the heat-sealed blocks thrusts the two sheets of inner film when the two sheets of outer film are contracted upward in a transverse direction, causing the portions of the two sheets of inner film on which the heat resisting material is spread to be thrust and contract in a longitudinal direction, thereby opening the air inlets automatically. Thereafter, the air in the air passage can then be moved into air columns via the air inlets.

BRIEF DESCRIPTION OF THE DRAWINGS

The present invention can be more fully understood by reference to the following description and accompanying drawings, in which.

DETAILED DESCRIPTION

Please refer to FIGS. 1, 2A, 2B, 3 and 4, in which the figures show an air-sealed body with automatically opened air valves according to a first preferred embodiment of the present invention.

An air-sealed body 1 with automatically opened air valves of the present invention includes two sheets of outer film 2*a*, 2*b*, two sheets of inner film 1*a*, 1*b*, a heat resisting material 1*c*, an air passage 9, plural air columns 6, plural heat-sealed blocks 5.

The two sheets of outer film 2*a* and 2*b* are stacked together vertically.

Figure 1:
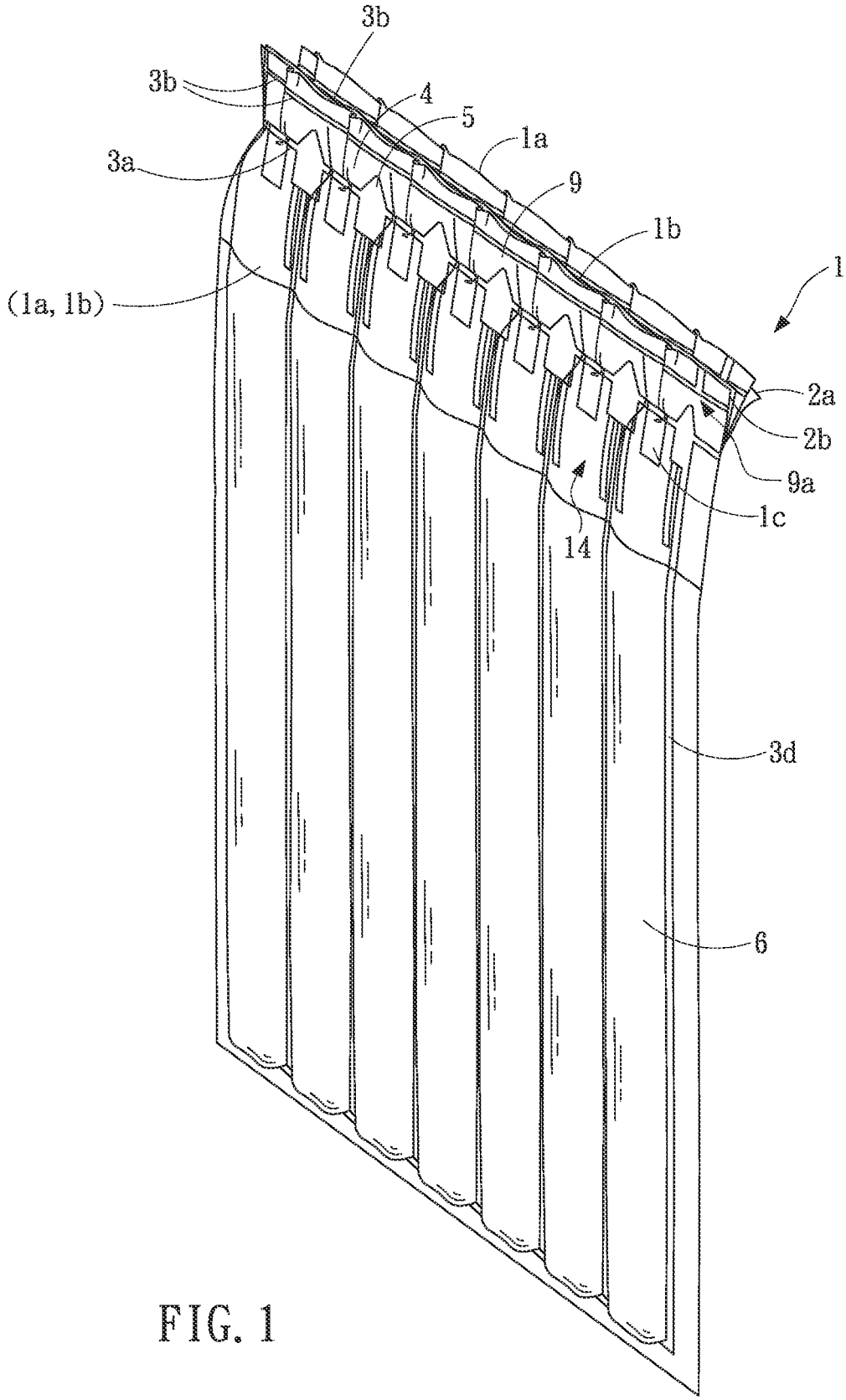
FIG. 1 is a perspective view of a first preferred embodiment according to the present invention after air filling.
Figure 2A:
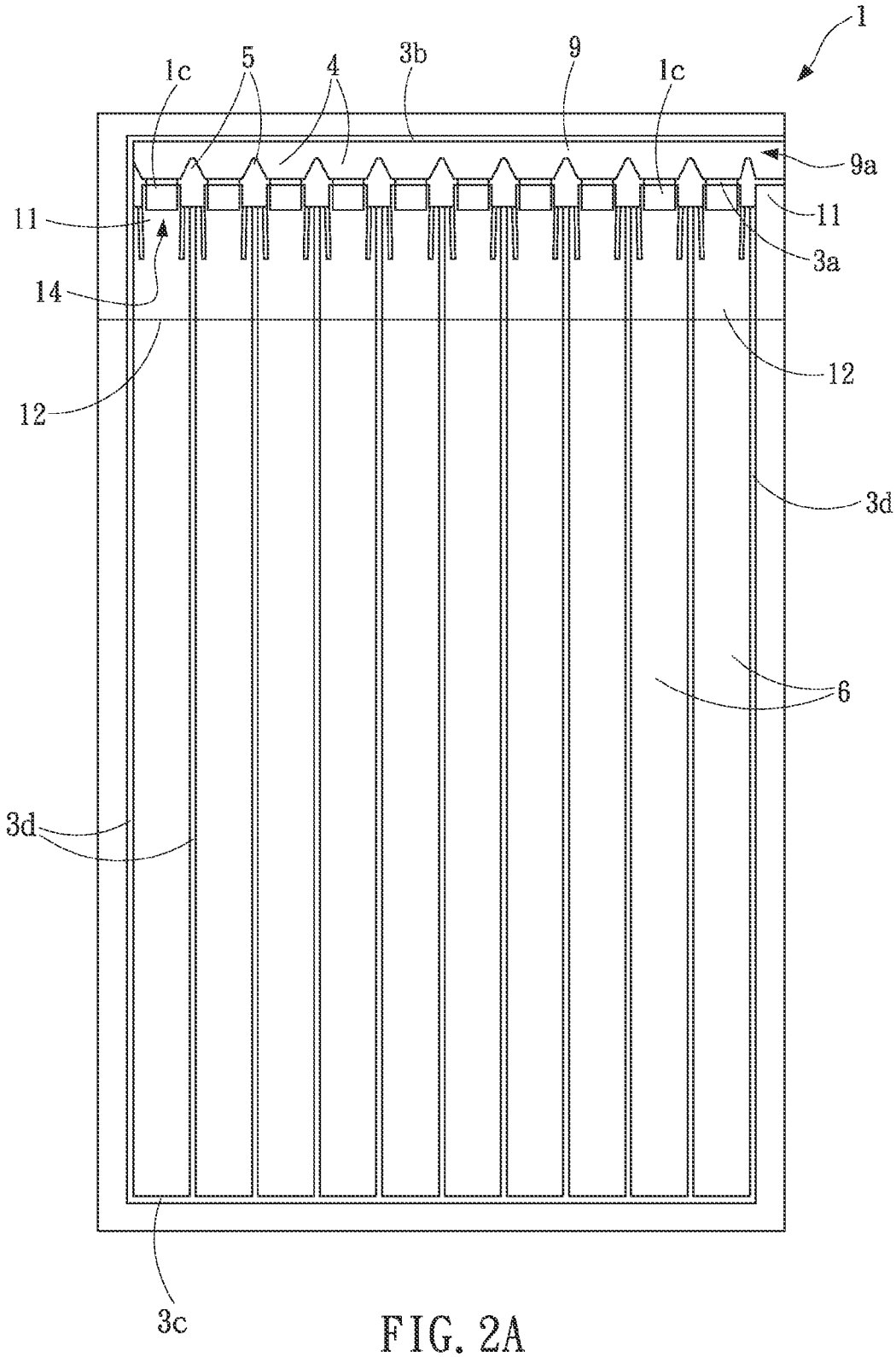
FIG. 2A is a plane view of the first embodiment according to the present invention before air filling.
Figure 2B:
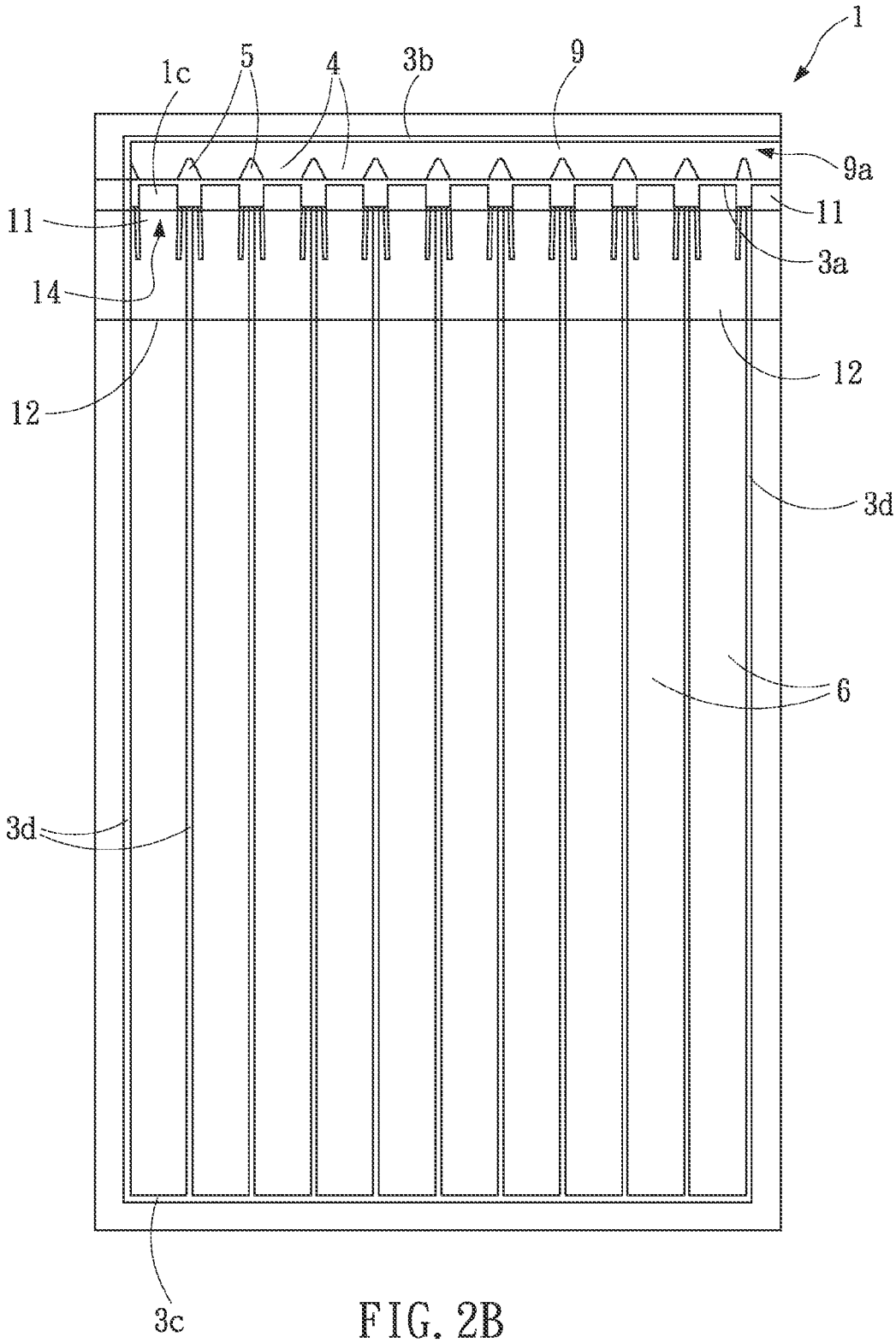
FIG. 2B is another plane view of the first embodiment according to the present invention before air filling.

The two sheets of inner film 1*a* and 1*b* are placed between the two sheets of outer film 2*a*, 2*b* and at a position slightly lower than the inner top of either outer film 2*a* or 2*b*. The width of either inner film 1*a*, 1*b* is approximately the same as the width of either outer sheet 2*a*, 2*b*, and the length thereof is shorter than the length of either outer film 2*a*, 2*b*. Each inner film has a first side 11 and a second side 12 opposite to each other. In addition, a heat resisting material 1*c* is spread distantly between the first sides 11 of the two sheets of inner film 1*a* and 1*b* as FIG. 2A shows, thereby using the heat resisting material 1*c* as air passable passages. In the present invention however, a long strip of heat resisting material having an length equal to the length of the first side 11 can also be spread between the two sheets of inner film 1*a* and 1*b* as FIG. 2B shows.

Heat sealing is carried out along a first transverse heat-sealing line 3*a* and a second transverse heat-sealing line 3*b* so as to adhere the two sheets of outer film 2*a* and 2*b* to the two sheets of inner film 1*a* and 1*b*, thereby forming an air passable air passage 9 and an air-filling port 9*a* at one end of the air passage 9. In addition, heat sealing is carried out along a second transverse heat-sealing line 3*c* to adhere the two sheets of outer film 2*a* and 2*b* together, and along plural longitudinal heat-sealing line 3*d* to adhere the two sheets of outer film 2*a*, 2*b* and the two sheets of inner film 1*a*, 1*b*, thereby forming plural air columns 6 between the two sheets of outer film 2*a* and 2*b*. Thereafter, plural air inlets 2*e* is formed on the places of the two sheets of inner film 1*a*, 1*b* overlapping with the first heat-sealing line 3*a* by adhering the two sheets of inner film 1*a* and 1*b* together by means of heat sealing after the heat resisting material 1*c* is spread between the two sheets of inner film 1*a* and 1*b*, where each air inlet 2*e* corresponds to one air column 6. Continuous air valves capable of filling air simultaneously to the air columns 6 can be constituted through the two sheets of inner film 1*a* and 1*b*.

Furthermore, the two sheets of outer film 2*a* and 2*b* and the two sheets of inner film 1*a* and 1*b* are adhered together by means of heat sealing to form plural heat-sealed blocks 5 at predetermined positions of the sides of the air inlets 2*e*. The heat-sealed block 5, here, is a long-strip-typed object; a part thereof is positioned in the air passage 9, and the heat-sealed block 5 is reduced in width from the side thereof near the first transverse heat-sealing line 3*a* to the other side thereof which is far away from the first transverse heat-sealing line 3*a*. In addition, an air leading passage 4 is formed between the two adjacent heat-sealed blocks 5, positioned between the two sheets of inner film 1*a* and 1*b* and connected to the air inlet 2*e*. The two adjacent heat-sealed blocks 5, as a whole, form peaks approximately, and the air leading passage 4 then forms an approximate valley.

Figure 3:
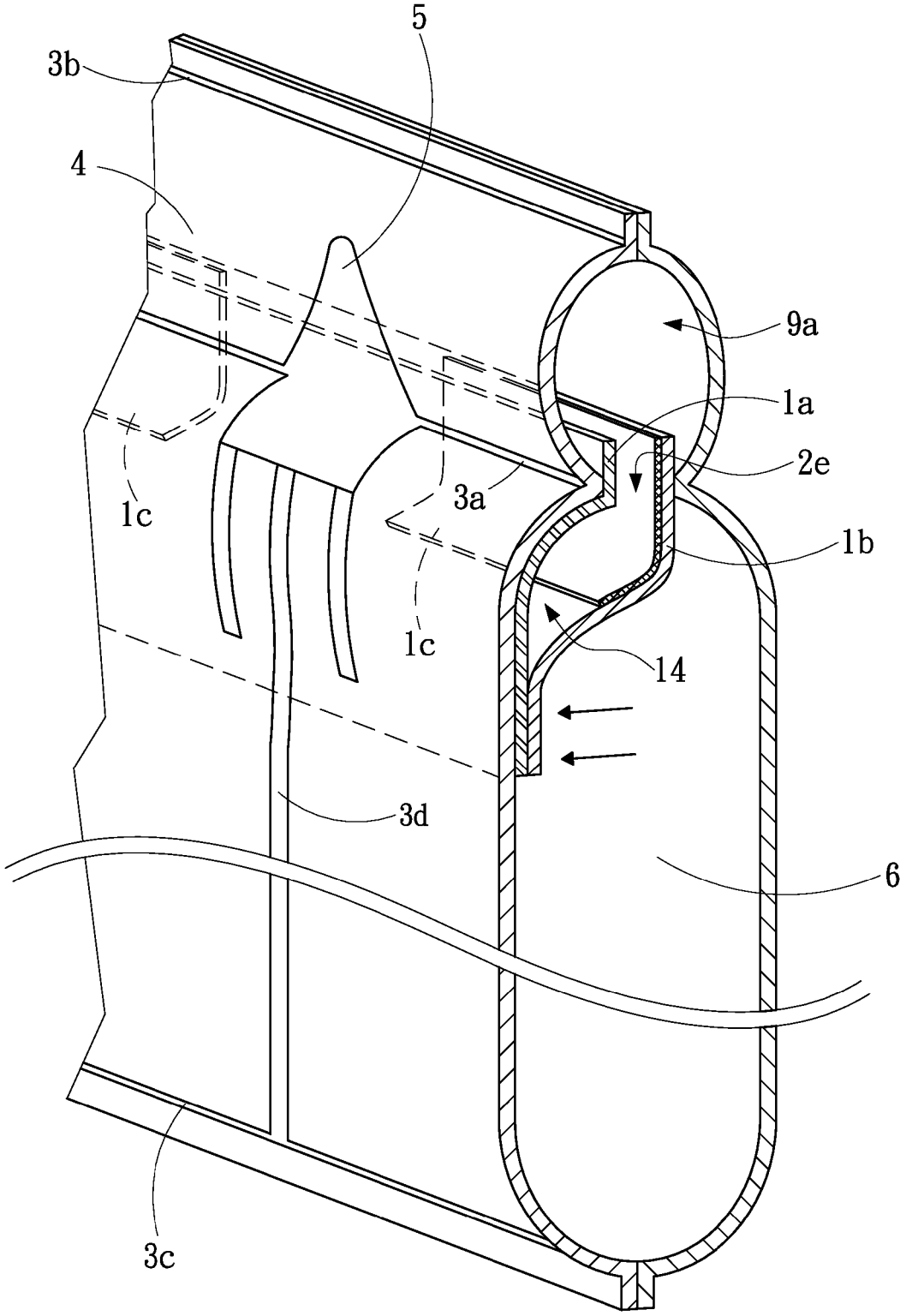
FIG. 3 is a cross-sectional view of the first embodiment according to the present invention after air filling.
Figure 4:
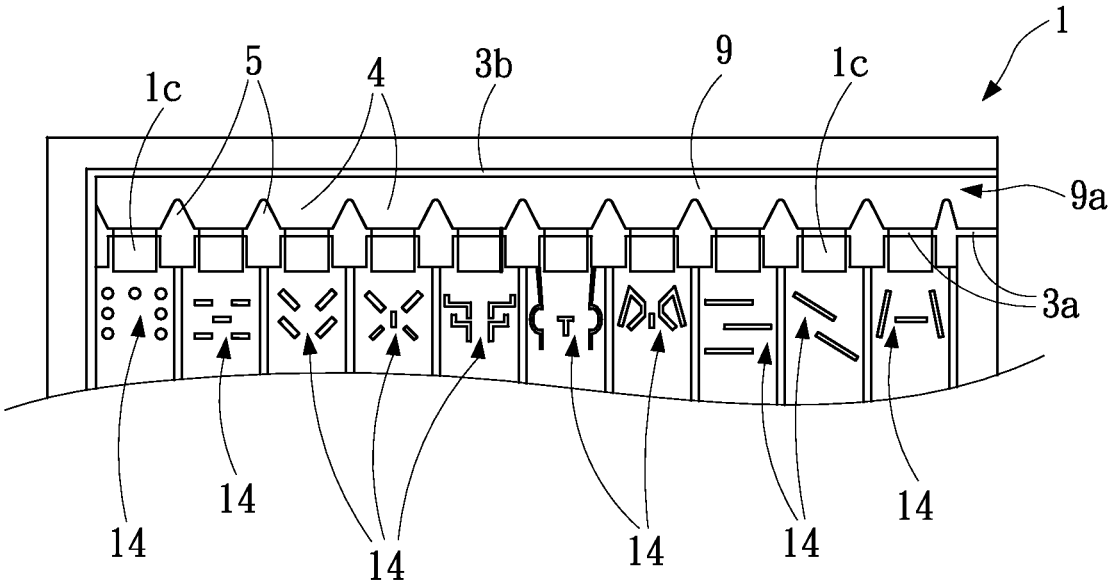
FIG. 4 is a schematic view of the first embodiment configured with a different air passage according to the present invention at another view of angle before air filling.

The two sheets of outer film 2*a* and 2*b* are pulled apart upward and outward in a longitudinal direction after the air entering the air-filling port 9*a* expands the air passage 9. Because the two sheets of outer film 2*a* and 2*b* are expanded from a planar state to a three dimensionally curved state, and the places not configured with heat sealing block 5 are expanded due to the air filling and the places configured with heat-sealed block 5 are not expanded during the air filling, the air passage 9 is contracted upward in a transverse direction due to a natural fall of level while being filled with air, causing the two sheets of outer film 2*a* and 2*b* forming the air passage 9 to be contracted to displace in a transverse direction, thereby pushing the heat-sealed blocks 5 so that they thrust the two sheets of inner film 1*a* and 1*b*, causing them to be pulled apart upward and outward in a longitudinal direction to open the air inlets 2*e* automatically as FIGS. 3 show; namely that the approximately peak-typed heat-sealed blocks 5 are thrust toward the valley-typed air leading passages 4, causing the two sheets of inner film 1*a* and 1*b* of each air leading passage 4 to be pulled apart outward such that breaches formed by spreading the heat resisting material 1*c* on the two sheets of inner film 1*a* and 1*b* first and then adhering them by heat sealing are thrust open automatically.

A single air passage 9 is sufficient to carry out the air filling to the air columns 6 simultaneously, due to the automatic opening of the air inlets 2*e* such that positioning and then filling air to each air inlet 2*e* is unnecessary, thereby saving air filling time. In addition, the entire cushioning effect of the air-sealed body 1 is unlikely to be influenced even if some air columns 6 are damaged because the air columns 6 are independent of one another.

The internal air pressure of the air columns 6 presses the second sides 12 of the two sheets of inner film 1*a* and 1*b* after the filled air enters the air columns 6 via the air leading passages 4 and the air inlets 2*e*, causing the two sheets of inner film 1*a* and 1*b* to be attached to each other and to close the air columns 6, thereby preventing the air from leaking and preventing air from escaping. The two sheets of inner film 1*a* and 1*b*, at this moment, are pressed by the air to hang in the air columns 6 or adhered to one of the two sheets of outer film 2*a* and 2*b*; the air presses the two sheets of inner film 1*a* and 1*b* to attach to the outer film 2*a* or 2*b* after entering the air columns 6, thereby closing the air columns 6.

Figure 5:
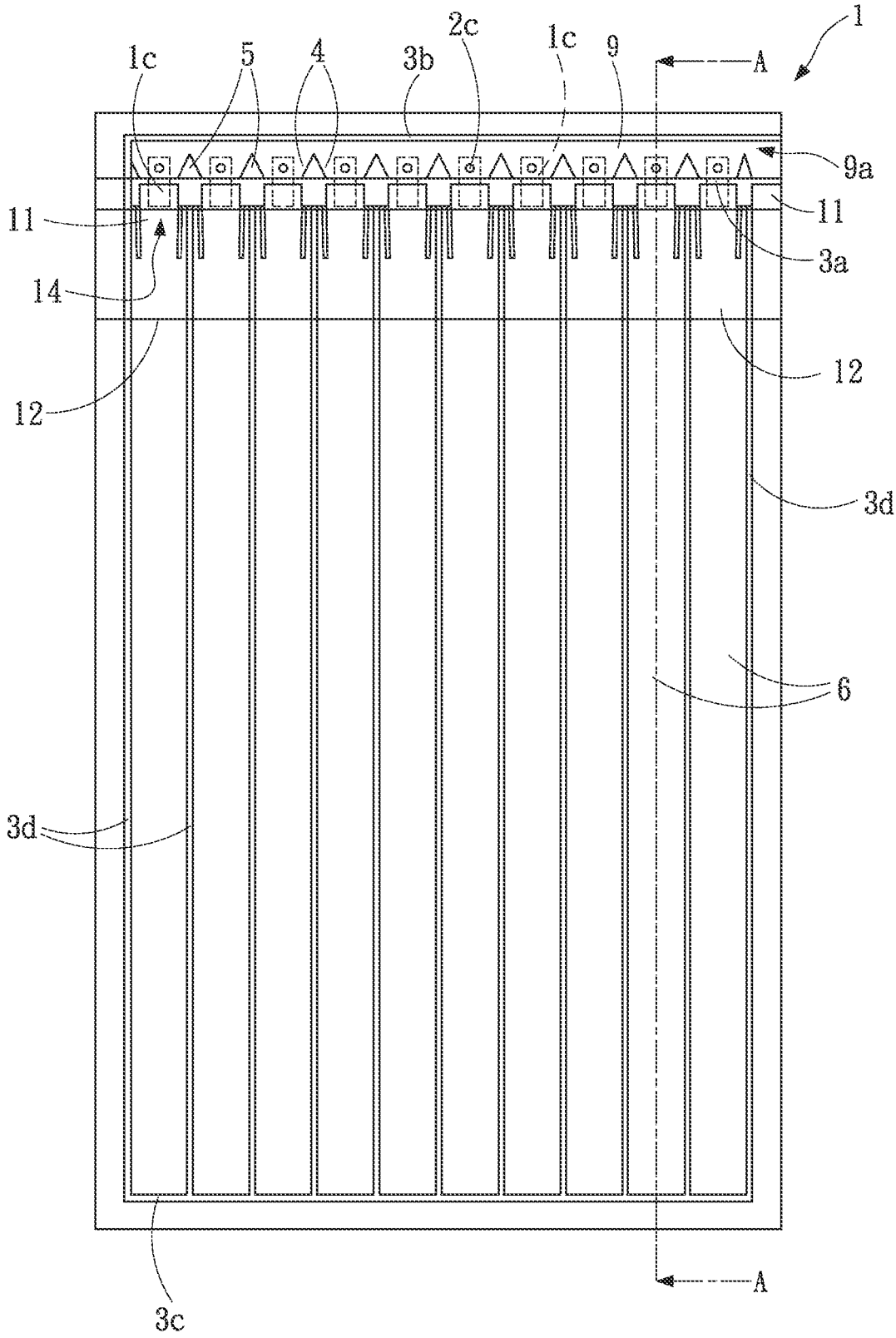
FIG. 5 is a schematic view of a second preferred embodiment according to the present invention.

In addition, plural air channels 14 may be formed by adhering the two sheets of inner film 1*a* and 1*b* together by means of heat-sealing before the two sheets of inner film 1*a* and 1*b* are stacked together between the two sheets of outer film 2*a* and 2*b*. The air channel 14 is connected to the air inlet 2*e*, and the width of one end of the air channel 14 connected to the air inlet 2*e* is larger than the width of another end thereof, allowing air to enter the air inlet 2*e* more easily than escape out of it. The air channel 14, here, may be gradually convergent from the air inlet 2*e*; when the internal air pressure of the air column 6 becomes greater, the air thrusts a curved portion of the air channel 14 tightly, thereby achieving the air locking However, the air channel 14 of the present invention is not limited to the straight line type; it may also be a mesh point or curve type as FIG. 5 shows, or may even be a changeable structure depending on a practical design requirement. In addition, the same structure of the air channels 14 may be configured between the two sheets of inner film 1*a* and 1*b*, or the air channels with a different structure may be configured miscellaneously between them.

The air column 6 mentioned above may be connected to one air inlet 2*e* or plural air inlets 2*e*, and each air inlet 2*e* may further be connected to one air channel 14 or plural air channels 14. Furthermore, each air column may communicate with the other, and may further share one air channel 14 or plural air channels 14.

Figure 6:
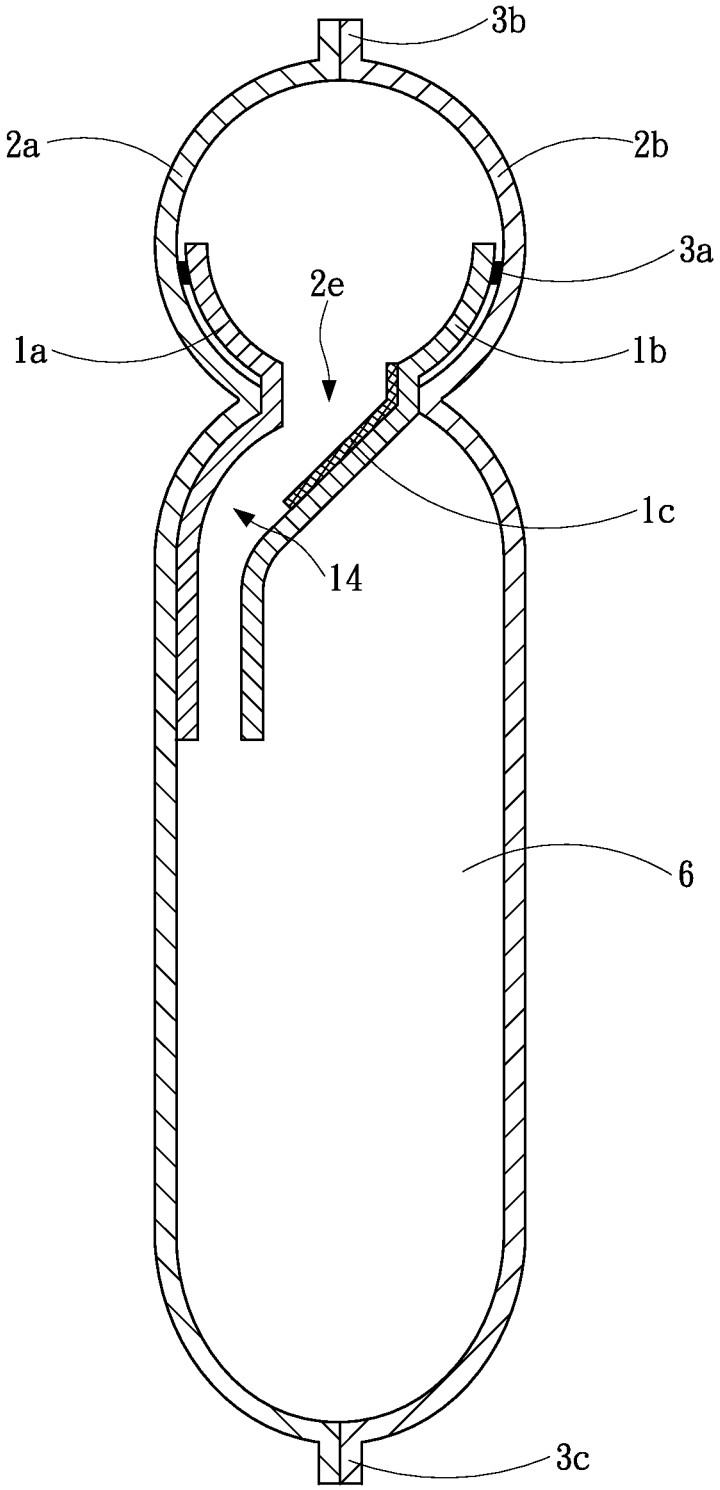
FIG. 6 is a cross-sectional view of the second embodiment according to the present invention after air filling.

Please refer to FIGS. 5 and 6, in which the figures show an air-sealed body with automatically opened air valves of a second preferred embodiment according to the present invention. The biggest difference between the present embodiment and the first embodiment is the configurations of plural heat-sealing points in the present embodiment. The heat-sealing points 2*c* are generated in the air passage 9 by means of heat sealing in the present embodiment, thereby adhering the outer film 2*a* to the inner film 1*a* and the outer film 2*b* to the inner film 1*b*. The air inlets 2*e* can be opened more effectively by driving to pull the two sheets of inner film 1*a* and 1*b* apart outward through the heat-sealing points 2*c* because the two sheets of outer film 2*a* and 2*b* are expanded from a planar state to a three dimensionally curved state and pulled apart outward after air enters the air passage 9.

A method for manufacturing an air-sealed body with automatically opened air valves includes the following steps:

Step 101: providing two sheets of inner film 1*a* and 1*b;*

In this step, each inner film (1*a* or 1*b*) includes a first side 11 and a second side 12 opposite to each other, and at least one heat resisting material 1*c* may be spread between the first sides 11 of the two sheets of inner film 1*a* and 1*b*, where the heat resisting materials 1*c* may be spread distantly between the first sides 11 of the two sheets of inner film 1*a* and 1*b*, thereby utilizing the heat resisting material 1*c* as an air passable passage, or a long strip of the heat resisting material 1*c* having the same length as the first side 11 may be spread between the two sheets of inner film 1*a* and 1*b*. In addition, plural air channels 14 may be formed by adhering the two sheets of inner film 1*a* and 1*b* together in advance by means of heat sealing.

Step 102: stacking the two sheets of outer film 2*a* and 2*b* together positioning the two sheets of inner film 1*a* and 1*b* between the two sheets of outer film 2*a* and 2*b;*

The two sheets of inner film 1*b* and 1*b* are positioned between the two sheets of outer film 2*a* and 2*b*, and a place slightly lower than the inner top of either outer film 2*a* or 2*b*.

Plural heat-sealing points 2*c* may be generated in the air passage 9 after this step, thereby adhering the outer film 2*a* to the inner film 1*a* and the outer film 2*b* to the inner film 1*b*.

Step 103: using a first transverse heat-sealing line 3*a* to adhere to the two sheets of inner film 1*a*, 1*b* and the two sheets of outer film 2*a*, 2*b*, and using plural second transverse heat-sealing lines 3*b*, 3*c* to adhere to the two sheets of inner film 1*a*, 1*b*. The second transverse heat-sealing lines 3*b*, 3*c* are positioned at the two ends of the inner films 1*a* and 1*b*. An air passage 9 including an air-filling port 9*a* through which air is filled in is formed in a space encircled by the two sheets of outer film 2*a* and 2*b* between the first transverse heat-sealing line 3*a* and the second transverse heat-sealing line 3*b*. And plural air inlets 2*e* are formed on the portions of the two sheets of inner film 1*a* and 1*b* on which the heat resisting material 1*c* is spread and overlapping with the first transverse heat-sealing line 3*a*.

Heat sealing is carried out along the first transverse heat-sealing line 3*a* and the second transverse heat-sealing line 3*b*, thereby adhering the two sheets of outer film 2*a* and 2*b* and the two sheets of inner film together so as to form the air passable air passage 9 between the two sheets of outer film 2*a* and 2*b*, and the air-filling port 9*a* on one end of the air passage 9. Furthermore, the two sheets of inner film 1*a* and 1*b* are adhered together by mean of heat sealing to form plural air inlets 2*c* on the portions where they overlap with the first transverse heat-sealing line 3*a* after the heat resisting material 1*c* is spread between them.

Step 104: using plural longitudinal heat-sealing lines 3*d* to adhere the two sheets of outer film 2*a*, 2*b* and the two sheets of inner film 1*a*, 1*b* to form plural air columns 6 communicating with the air passage 9 through the air inlets 2*e* between the two sheets of outer film 2*a* and 2*b* among the first transverse heat-sealing 3*a*, the other second transverse heat-sealing line 3*c* and the longitudinal heat-sealing line 3*d*.

Heat sealing is carried out along the second transverse heat-sealing line 3*c* to adhere the two sheets of outer film 2*a*, 2*b* together, and along the longitudinal heat-sealing lines 3*d* to adhere the two sheets of outer film 2*a*, 2*b* and the two sheets of inner film 1*a*, 1*b* together, thereby forming the air columns 6 between the two sheets of outer film 2*a* and 2*b*. Each air inlet 2*e*, here, corresponds to one air column 6, and the air inlet 2*e* may be connected to the air channel 14. Subsequently, continuous air valves capable of carrying out simultaneous air filling to the air columns 6 are constituted by the two sheets of inner film 1*a* and 1*b*.

Step 105: adhering the two sheets of outer film 2*a*, 2*b* and the two sheets of inner film 1*a*, 1*b* together by means of heat sealing to form plural heat-sealed blocks 5, where at least one part of each heat-sealed block 5 is positioned in the air passage 9, and the heat-sealed block 5 is reduced in width from one side thereof near the first transverse heat-sealing line 3*a* to another end thereof.

The two sheets of outer film 2*a*, 2*b* and the two sheets of inner film 1*a*, 1*b* are adhered together by means of heat-sealing to form the heat-sealed blocks 5 on predetermined positions of the sides of the air inlets 2*e*; the heat-sealed block, here, is positioned in the air passage 9, and shrinking gradually from one side thereof near the first transverse heat-sealing line 3*a* to another end thereof far away from the first transverse. In addition, an air leading passage 4 is formed between the two adjacent heat-sealed blocks 5, and the air leading passage 4 is positioned between the two sheets of inner film 1*a* and 1*b* and connected to the air inlet 2*e*; the two adjacent heat-sealed blocks 5, as a whole, approximately are peaks, and the air leading passage 4 approximates a valley.

The two sheets of outer film 2*a* and 2*b* are pulled apart upward and outward in a longitudinal direction after the air entering the air-filling port 9*a* expands the air passage 9, and the two sheets of outer film 2*a*, 2*b* are contracted upward in a transverse direction because they are expanded from a planar state to a state of steradian.

The positions configured with the heat-sealed blocks 5 will not be expanded and the positions not configured with the heat-sealed block 5 will be expanded when air is poured into the air passage 9 because the heat-sealed blocks 5 are configured by means of heat sealing in advance at the predetermined positions of the two sheets of outer film 2*a*, 2*b* of the air passage 9; both are contracted upward in a transverse direction because of a natural fall of level, allowing the heat-sealed blocks 5 to be displaced upward in a transverse direction following the contraction of the two sheets of outer film 2*a*, 2*b*, i.e. the approximately peak-typed heat-sealed blocks 5 are thrust toward the valley-typed air leading passages 4, causing the two sheets of inner film 1*a* and 1*b* of the air leading passages 4 to be pulled apart outward, thereby thrusting the portions of the two sheets of inner film 1*a* and 1*b* spread with the heat resisting material 1*c* to be pulled apart upward and outward in a longitudinal direction and thus automatically open the air inlets 2*e* accordingly; the breaches formed by spreading the heat resisting material 1*c* on the two sheets of inner film 1*a* and 1*b* first and then adhering them by means of heat sealing, namely, are pressed open automatically. The air flows into the air columns 6 via the air passages 14 after the air inlets 2*e* are opened allowing the air to enter the air inlets 2*e*, and air locking can then be carried out through the air passages 14 to prevent the air from flowing reversely, thereby allowing only one air passage 9 to carry out the simultaneous air filling to the air columns 6.

The internal air pressure of the air columns 6 presses the second sides 12 of the two sheets of inner film 1*a* and 1*b*, allowing the two sheets of inner film 1*a* and 1*b* to attach to each other to close the air columns 6, thereby preventing the air from leaking and achieving the air locking. The two sheets of inner film 1*a* and 1*b*, here, are pressed by the air to hang in the air columns 6, or the two sheets of inner film 1*a* and 1*b* can be adhered to one of the outer film 2*a* or 2*b*; the air presses the two sheets of inner film 1*a* and 1*b* to attach to the outer film 2*a* or 2*b* to close the air columns 6 after entering the air columns 6.

The two sheets of outer film of the present invention are thrust by air to pull apart outward during the air filling, causing the two sheets of outer film to be pulled apart upward and outward in a longitudinal direction and contracted upward in a transverse direction, and the two sheets of inner film, in the meantime, are thrust by the heat-sealed blocks, causing the two sheets of inner film to be thrust upward in a longitudinal direction to open the air inlets automatically. Thereafter, the air in the air passage can be moved into the air columns via the air inlets. In conclusion, the air inlets can be opened accurately according to the present, allowing air to be filled into the air columns and the air columns to be filled with air to expand, thereby solving effectively the problems found in a conventional air-sealed body such as the incapability of opening an air passing inlet because two sheets of inner film of a switch still adhere to each other.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An air-sealed body, comprising:

two outer films, stacked together vertically;

two inner films, positioned between the two outer films;

a plurality of heat resisting materials, spread between the two inner films;

a first transverse heat-sealing line, adhered the two inner films and the two outer films;

a plurality of second transverse heat-sealing lines, positioned at two ends of each of the two outer films and adhered the two outer films;

an air passage, positioned in the two outer films between the first transverse heat-sealing line and one of the second heat-sealing lines, the air passage comprising an air-filling port for filling air;

a plurality of longitudinal heat-sealing lines, adhered the two outer films and the two inner films;

a plurality of air columns, positioned between the two outer films among the first transverse heat-sealing line, the other one of the second transverse heat-sealing lines and the longitudinal heat-sealing lines;

a plurality of air inlets, formed by heat sealing the two outer films and the two inner films together on the portions that the two inner films are spread with the heat resisting material and overlapping with the first transverse heat-sealing line, and adapted to communicate the air passage with the air columns;

a plurality of heat-sealed blocks, comprising a first portion and a second portion, the first portion positioned in the air passage, adhering the two outer films and the two inner films, and the first portion having a first side and a second side, the heat-sealed blocks being reduced in width from the first side near the first transverse heat-sealing line to the second side for guiding the air flowing toward the air inlets, the second portion positioned on each of the longitudinal heat-sealing lines and protruded out of the longitudinal heat-sealing line, two sides of the heat resisting material adjacent adhered the heat-sealed blocks respectively to form the air inlet between two adjacent heat-sealed blocks, one end of the heat resisting materials aligned with the first side of the first portion, another end of the heat resisting materials aligned with the lower periphery of the second portion; and a plurality of heat sealing points, positioned in the air passage, disposed corresponding to a middle portion between the first side and the second side, and adhered one of the two inner films and one of the two outer films adjacent thereto:

wherein the air enters the air-filling port and expands the air passage, and the two outer films are pulled apart upward and outward in a longitudinal direction and contracted upward in a transverse direction to drive the heat-sealed blocks to move and thrust the two inner films, and the portions of the two inner films spread with the heat resisting material are pulled apart upward and outward in a longitudinal direction to open the air inlets, meanwhile since the two outer films are deformed from a flat structure to a three dimensional structure with arced outline and pulled apart outward, the opening of the air inlet is ensured via driving the two inner films to be pulled apart outward by the heat sealing points, and after entering the air columns through the air inlet the air presses the two inner films to close the air columns.

2. The air-sealed body according to claim 1, further comprising a plurality of air channels connected to the air inlets, the air channels being spaces formed by heat sealing the inner films.

3. The air-sealed body according to claim 1, further comprising a plurality of air leading passages, positioned among the heat-sealed blocks.

4. A method for maturing an air-sealed body, comprising the steps of:

providing two inner films with a plurality of heat resisting materials spread between the two inner films;

stacking two outer films together with the two inner films positioned between the two outer films;

adhering the two inner films and the two outer films with a first transverse heat-sealing line, and adhering the two outer films with a plurality of second transverse heat-sealing lines, wherein the second transverse heat-sealing lines are positioned at two ends of the outer films and form an air passage encircled by the two outer films between the first transverse heat-sealing line and one of the second heat-sealing lines, the air passage comprising an air-filling port for filling air, and a plurality of air inlets being formed on the portions of the two inner films that are spread with the heat resisting material and overlapping with the first transverse heat-sealing line;

adhering the two outer films and the two inner films with a plurality of longitudinal heat-sealing lines to form a plurality of air columns encircled by the two outer films between the first transverse heat-sealing line, the other one of the second transverse heat-sealing lines and the longitudinal heat-sealing lines, the air columns communicating with the air passage through the air inlets;

adhering the two outer films and the inner film to form a plurality of heat-sealed blocks comprising a first portion and a second portion, the first portion positioned in the air passage, and the first portion having a first side and a second side and being reduced in width from the first side near the first transverse heat-sealing line to the second side for guiding the air flowing to the air inlet, the second portion positioned on each of the longitudinal heat-sealing lines and protruded out of the longitudinal heat-sealing line, two sides of the heat resisting materials adjacent adhered the heat-sealed blocks respectively to form the air inlet between two adjacent heat-sealed blocks, one end of the heat resisting material aligned with the first side of the fist portion, another end of the heat resisting materials aligned with the lower periphery of the second portion; and adhering one of the two inner films and one of the two outer films adjacent thereto with a plurality of heat-sealing points, the heat-sealing points being positioned in the air passage and disposed corresponding to a middle portion between the first side and the second side.

5. The method for manufacturing an air-sealed body according to claim 4, wherein an air leading passage is formed between the two heat-sealed blocks.

6. The method for manufacturing an air-sealed body according to claim 4, further comprising a step of: heat-sealing the two inner films to form a plurality of air channels respectively connected to the air inlets between the two inner films after the step of providing two inner films.

* * * * *